US006094149A

United States Patent [19]

Wilson

[11] Patent Number: 6,094,149

[45] Date of Patent: Jul. 25, 2000

[54] SCHOOL BUS ALERT

[76] Inventor: Joseph F. Wilson, 717 McLean Ct., Nixa, Mo. 65714

[21] Appl. No.: 08/943,496

[22] Filed: Oct. 3, 1997

Related U.S. Application Data

[60] Provisional application No. 60/027,645, Oct. 4, 1996.

[51] Int. Cl.[7] ..... G08G 1/00

[52] U.S. Cl. ..... 340/904; 340/901; 340/905; 340/907; 340/433; 340/539; 701/2

[58] Field of Search ..... 340/901, 902, 340/904, 905, 906, 907, 433, 539; 701/2

[56] References Cited

U.S. PATENT DOCUMENTS

| | | | |
|---|---|---|---|
| D. 347,289 | 5/1994 | Maki | D26/28 |
| 3,881,169 | 4/1975 | Malach | 340/32 |
| 4,017,825 | 4/1977 | Pichey | 340/32 |
| 4,115,757 | 9/1978 | Blahunka | 340/32 |
| 4,325,057 | 4/1982 | Bishop | 340/539 |
| 4,350,969 | 9/1982 | Greer | 340/994 |
| 4,736,186 | 4/1988 | Jones | 340/331 |
| 4,843,337 | 6/1989 | Conn, Jr. et al. | 340/906 |
| 5,187,476 | 2/1993 | Hamer | 340/906 |
| 5,493,295 | 2/1996 | Lewiner et al. | 340/994 |
| 5,554,982 | 9/1996 | Shirkey et al. | 340/903 |
| 5,572,201 | 11/1996 | Graham et al. | 340/902 |
| 5,680,119 | 10/1997 | Magliari et al. | 340/904 |

*Primary Examiner*—Jeffery A. Hofsass
*Assistant Examiner*—Daryl C. Pope
*Attorney, Agent, or Firm*—Jonathan A. Bay

[57] ABSTRACT

A School bus alert system has a school bus outfitted with message emitter. The school bus alert system also includes a set of roadway signs having alarm units directly or indirectly responsive to the messages emitted by the school bus emitter. The roadway signs are provided along the roadway approaches to a given bus stop. Upon activation by the messages from the school bus, the alarm units go active and give off an obvious sensible warning that is reasonably interpretable by motorists or drivers that (i) they—the motorists or drivers—are approaching the given bus stop and (ii) there concurrently is a school bus stopped or servicing passengers at the bus stop.

9 Claims, 4 Drawing Sheets

SCHOOL BUS ALERT

CROSS-REFERENCE TO PROVISIONAL APPLICATION

This application claims the benefit of U.S. Provisional Application No. 60/027,645, filed Oct. 4, 1996.

BACKGROUND AND SUMMARY OF THE INVENTION

The invention generally relates to school bus alert system and method and more particularly to roadway sign that has an obvious sensible warning device which is reasonably interpretable by drivers that (i) they are approaching a bus stop zone and (ii) there concurrently is a school bus stopped at the bus stop zone or proximately so. A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
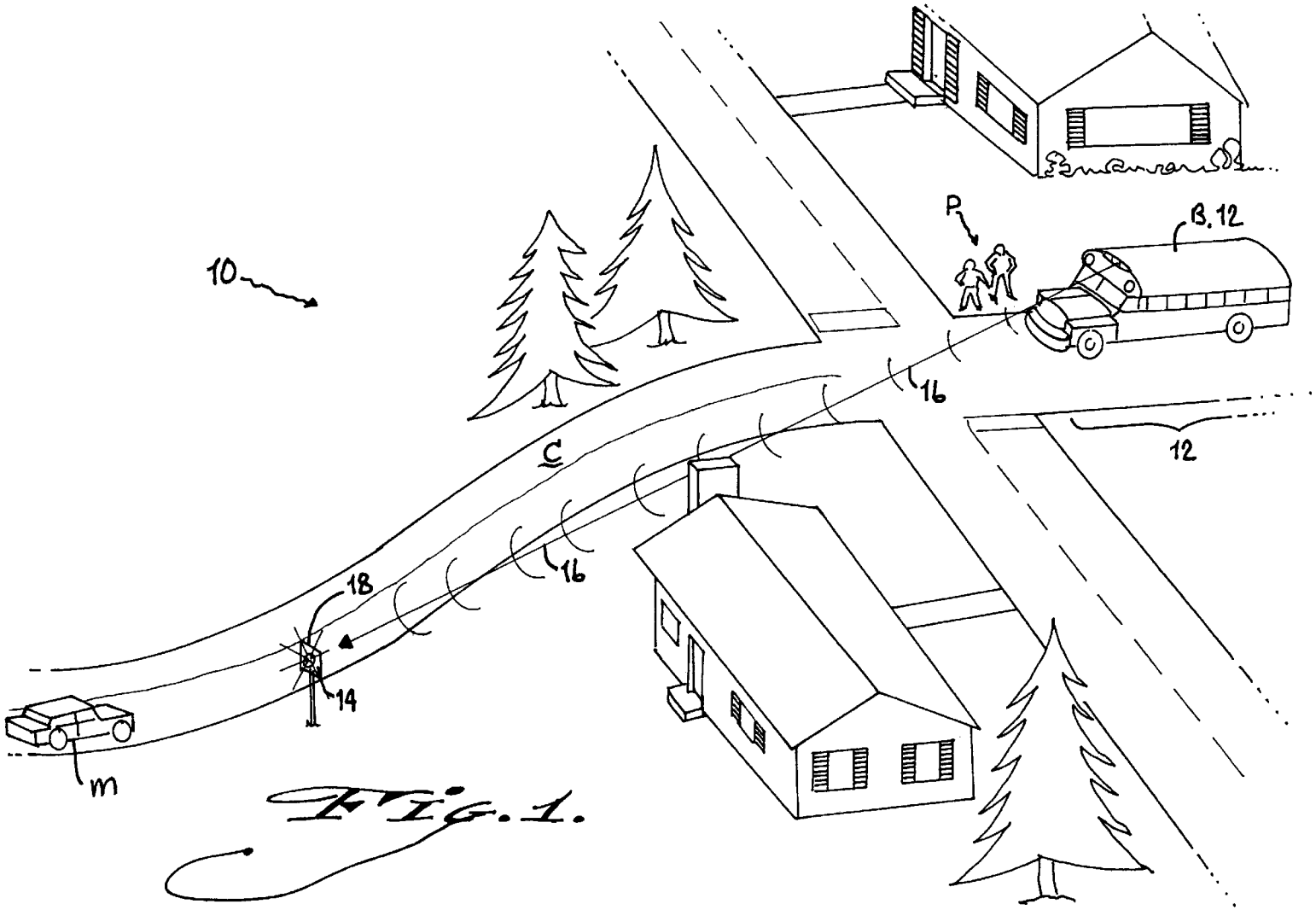
FIG. 1 is a perspective view of a school bus alert system in accordance with the invention.

FIG. 1 shows a school bus alert system 10 in accordance with the invention. In FIG. 1, the situation is isolated down to a simple matter of a given school bus B stopped at one stop zone 12 and communicating with one roadway sign 14 to alert an oncoming motorist or driver M. The school bus B includes a radio transmitter (not in view, but see FIG. 4). The roadway sign 14 correspondingly includes a radio receiver (also not in view, but see FIG. 4). The radio signal 16 emitted or radiating away from the school bus B activate a flashing light 18 on the sign 14 for the period of time the bus B is stopped and/or servicing the on- or off-boarding of passengers P. The flashing light 18 reasonably attracts the attention of passing motorists M and alerts them to the fact that a stopped school bus B is ahead. That way, motorists M can slow their speed and approach the stop zone 12 more cautiously, even if the stop zone 12 lies out of sight of the approaching motorist M, as it is for example around a curve C in the road or over a hump of a hill (not shown) and the like.

The alert sign 14/18 can be given any suitable format which is reasonably interpretable by a driver or motorist M that (i) they are approaching a bus stop zone 12 and (ii) there concurrently is a school bus B stopped at this bus stop zone 12. The format preferred by the inventor hereof is a sign reciting in large block letters the declaration "SCHOOL BUS STOPPED AHEAD WHEN FLASHING," in combination with a flasher 18 which is only active for the applicable period of time that a school bus B is indeed stopped or proximately stopped at the stop zone 12. That is, the flasher 18 is ordinarily dormant for most of the day that no school bus is around or servicing the given bus stop 12. However, while a school bus B is servicing the stop zone 12, the radio signal 16 causes the flasher 18 to go active for the applicable period of time that is appropriate. Once the school bus B has completed servicing that stop zone 12, the flasher 18 is allowed or caused to fall dormant until its next use period, which may be many hours later in the day, or the next day or following the weekend and the like.

Other formats of emergency warning are deployable in this use environment of the school bus alert system 10, which other formats may be known from other use environments such as for example the audible and visible siren attached to an intersection light as shown by U.S. Pat. No. 4,017,825—Pichey, the disclosure of which is incorporated herein by this reference.

Figure 2:
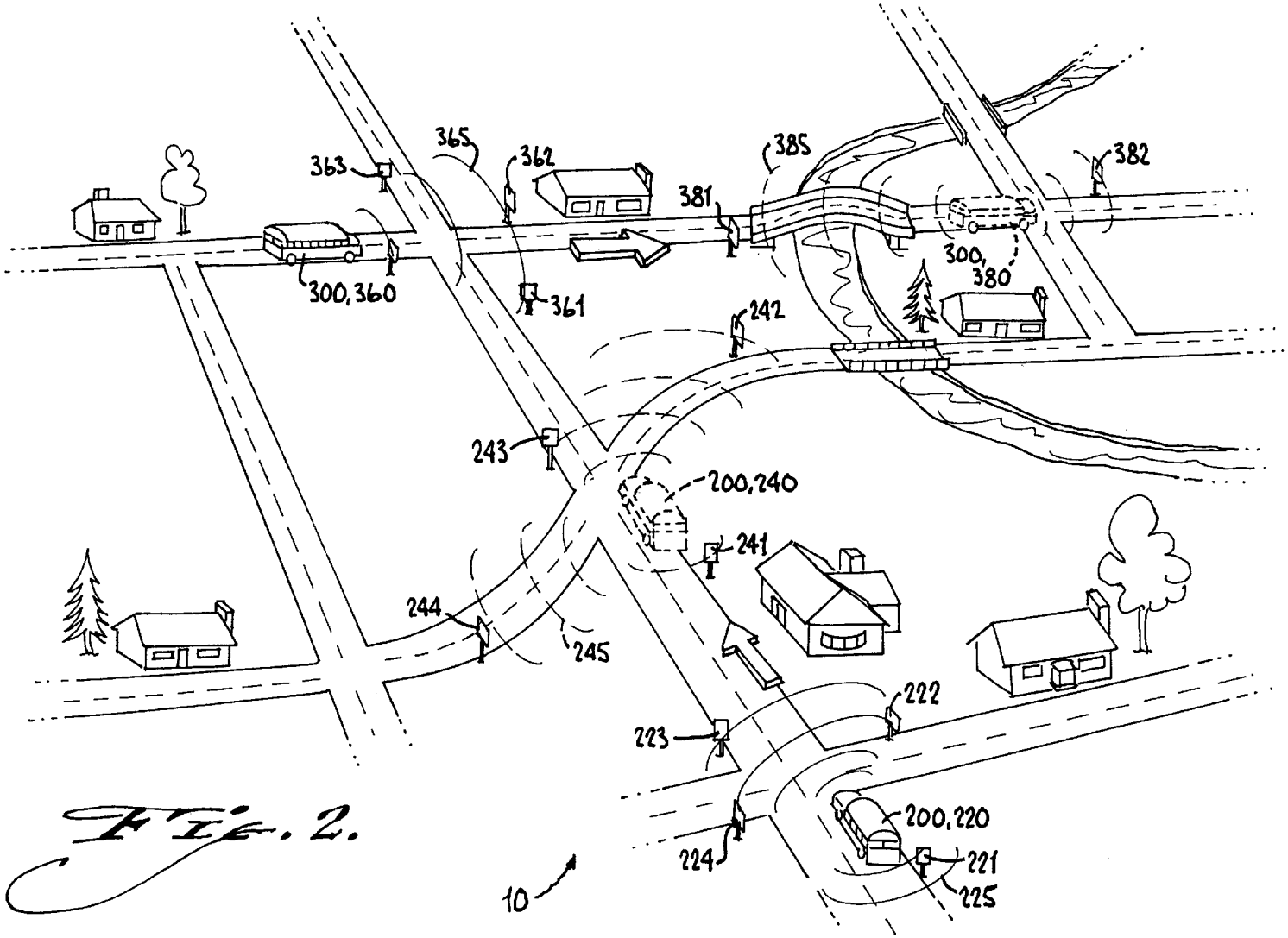
FIG. 2 is a perspective view comparable to FIG. 1 except that the school bus alert system is configured in a network in accordance with the invention.

FIG. 2 shows a network of bus stop zones (i.e., 220, 240, 360, 380) serviced by at least two school buses 200 and 300. Each given bus stop zone is associated with one or more alert signs that pertain to that given bus stop zone only. One issue which is addressed by the school bus alert system 10 in accordance with invention is aspect of reliably controlling the pertinent alert signs while a given school bus is servicing given stop zone, and not errantly activating any other, non-pertinent alert signs.

More particularly, FIG. 2 shows school bus 200 servicing stop zones 220 and 240. The alert signs that pertain to stop zone 220 are 221–224. The signs pertinent to stop zone 240 are signs 241–244. An inventive aspect of the school bus alert system 10 is its ability to selectively activate the alert signs which pertain to the bus stop zone presently being serviced by a school bus, and not others. As FIG. 2 shows, while school bus 200 is servicing stop zone 220, only alert signs 221–224 are caused to become active and flash, while signs 241–244 remain dormant. As the bus 200 proceeds from zone 220 to zone 240, the signs 221–224 are allowed or caused to fall dormant. School bus 200 causes signs 221–224 to go active or fall dormant by means of radio signal 225. Upon reaching zone 240, bus 200 causes activation of signs 241–244 by means of radio signal 245.

FIG. 2 shows school bus 300 servicing bus stop zones 360 and 380. The signs that pertain to stop zone 360 are 361–363 as controlled by radio signal 365. The signs pertinent to stop zone 380 are signs 381 and 382 controlled by radio signal 385. Given these two school buses 200 and 300 servicing their respective bus stop zones 220/240 and 360/380, the school bus alert system 10 is configured so to prevent buses 200 and 300 from giving false positive signals to the wrong signs while reliably causing the appropriate signs to go active. One way of accomplishing this result is by configuring the radio-frequency processing circuits (not shown, but see FIG. 4) of the alert signs to measure signal strength:—i.e., by means of R.F. threshold-level detector circuits (again, not shown, but see FIG. 4 for depiction of them there and as described more fully below in connection with that FIG. 4) ("R.F." being short form for the term "radio frequency") .

Thus, the signs 241–244 are adjusted so that the flashers go active in the situation when radio signal 245 is (i) received and (ii) has the requisite given threshold strength. The threshold-level detector circuits can be appropriately configured so that this situation only occurs when school bus 200, while servicing bus stop zone 240, begins broadcasting its radio signal 245. The radio signal is likely to reach the alert signs 361–363 associated with bus stop zone 360, however the threshold-level detector circuits there are adjusted such that they ignore the radio signal 245 because too weak. In reverse, the alert signs 241–245 will ignore radio signal 365 because it too is too weak when it reaches them to pass the threshold-level detector circuits of those signs 241–244.

The foregoing is a sufficient method of controlling a network of radio-controlled alert signs as long as the alert signs that pertain to each bus stop zone can be located within a given perimeter for that bus stop zone to which they do pertain, and not lie in the perimeter of another bus stop zone to which they do not pertain.

Figure 3:
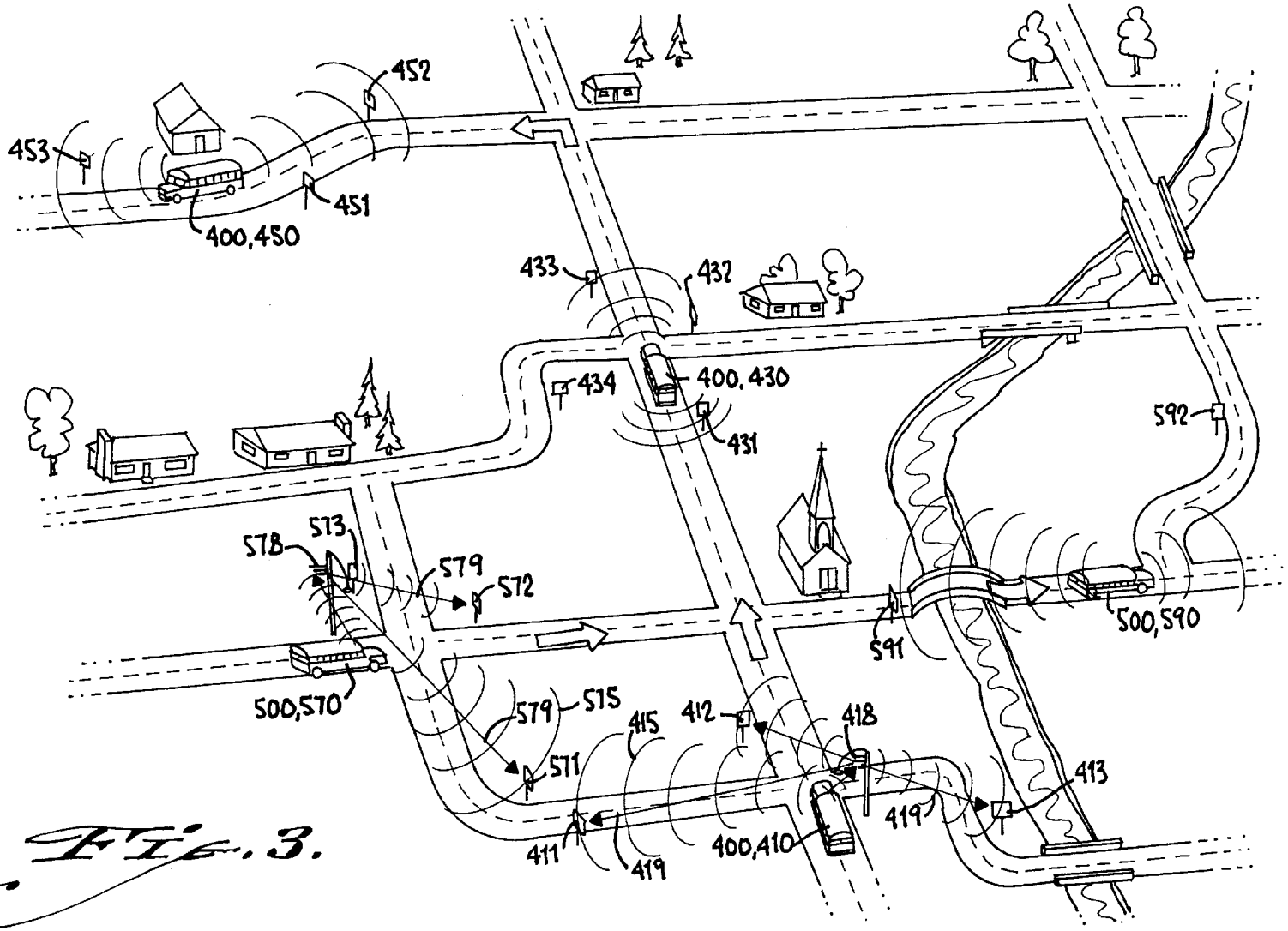
FIG. 3 is a perspective view comparable to FIG. 2 except that the network for the school bus alert system includes curbside relay stations; and, FIG. 4 is a diagrammatic view of the school bus alert system in accordance with the invention applicable alternatively to the FIG. 2 and FIG. 3 embodiments.

FIG. 3 shows a more crowded network which requires a higher level of message signal handling than can be accomplished by mere threshold-level circuits alone. FIG. 3 shows school bus 400 servicing stop zones 410, 430 and 450. The alert signs which are pertinent to zone 410 are signs 411–413. The alert signs pertinent to zone 430 are signs 431–434, and the signs pertinent to zone 450 are signs 451–453. There is also school bus 500 servicing stop zones 570 and 590. The alert signs pertinent to zone 570 are signs 571–573, and the signs pertinent to zone 590 are signs 591–592.

It can be seen that sign 411 for stop zone 410 is practically next door to sign 571 for stop zone 570. Indeed signs 411 and 571 are only across the road from each other. Bus 400 is responsible for issuing signal 415 while servicing stop 410, as bus 500 is responsible for issuing signal 575 while servicing stop zone 571. A problem would occur if signs 411 and 571 were activated on mere signal strength alone because of the following. Signal 415 is likely to reach signs 411 and 571 at the same strength. Likewise, signal 575 is likely to reach at signs 571 and 411 at the same strength. Threshold-level detector circuits could not be reliably depended on so that sign 411 would activate upon signal 415 but ignore signal 575, and vice versa.

Accordingly, it will be noticed that next to each of stop zones 410 and 570 there are street lights that carry relay stations 418 and 578. Relay station 418 services stop zone 410 as relay station 578 services stop zone 570. In this arrangement, relay station 418 is tuned for signal 415. When relay station 418 senses signal 415 after the strength of signal 415 has crossed a given threshold, that means to relay station 418 that bus 400 is presently servicing stop zone 410. In response to the condition that bus 400 is present at stop 410, relay station 418 emits and encoded signal 419. The encoded signal is 419 is detected by both signs 411 and 571, however only sign 411 is configured to decode from signal 419 a message to "go active," while sign 571 does not decode its specific "go active" message and hence remains dormant. The reverse situation is handled by relay station 578 for stop zone 570 and bus 500. The signal 575 when it reaches relay station 578 at an appropriate strength causes relay station 578 to send encoded signal 579. The encoded signal is 579 is detected by both signs 571 and 411, however only sign 571 is configured to decode from signal 579 a message to "go active," while sign 411 does not decode its appropriate "go active" message and hence remains dormant.

Figure 4:
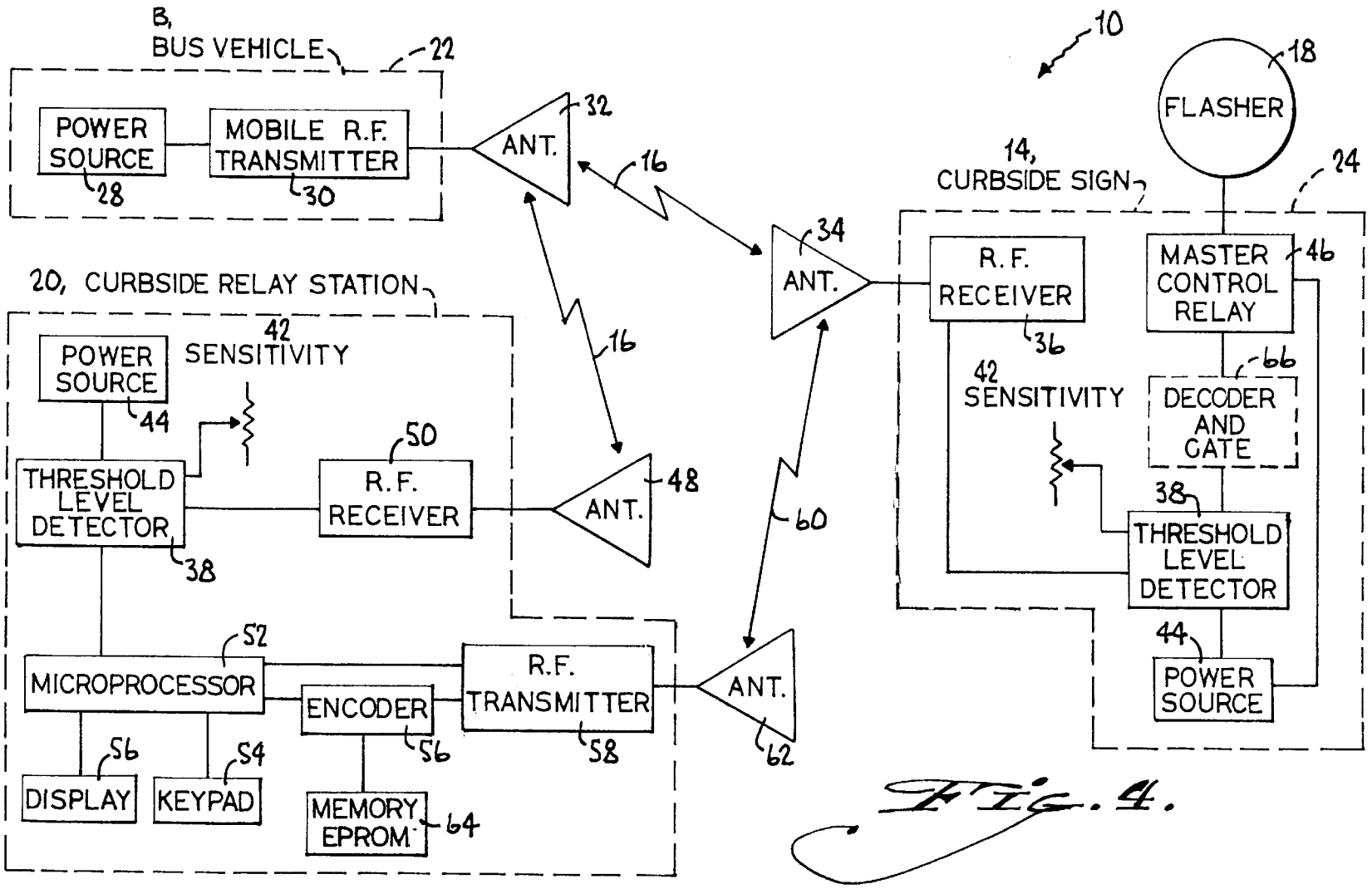

The foregoing is accomplished by at least circuits configured as shown by FIG. 4. Whereas FIG. 4 shows one example of how to configure circuits for the bus alert system in accordance with the invention, persons having ordinary skill in the art would be able to devise countless other routine variations on what is shown by FIG. 4. Hence the circuits shown by FIG. 4 is included here merely for convenience in this description and is not a limiting example.

With reference to FIG. 4, the bus alert system 10 in accordance with the invention includes a bus B configured with radio transmitter module 22, an alert sign 14/18 configured with a flasher 18 and a control system 24 responsive to a given radio signal such as for example radio signal 16 as described in connection with FIG. 1, and an optional curbside relay station 20.

FIGS. 1 and 2 referred to a bus alert control system 10 which operated by deployment simply of a mobile transmitter module 22 installed in a bus and a control system module 24 installed on a sign 14 to control operation of the flasher 18. In other words, it did not include a relay station 20 introduced in FIG. 3. The invention 10 in this form (i.e., modules 22 and 24 only) has the following aspects to it.

The mobile transmitter module 22 has a power source 28 supplying power to a mobile R.F. transmitter 30 whose signal is transmitted by antenna 32. The power source 28 is preferably the battery of the bus B although it could alternatively be a self-contained battery. The R.F. transmitter can be simply an A.M. frequency transmitter as is well known in the art. The control module 24 has an antenna 34 for incoming signal 16 coupled to R.F. receiver 36. The received signal is supplied to threshold level detector 38, which has adjustable sensitivity by means of adjustment control 42. If the received signal is too weak, then that corresponds to a signal which is not a product of the bus servicing the given stop zone to which this sign 14 pertains. No further action occurs in the circuits 24 if the received signal is too weak to cross the threshold.

On the other hand, if the received signal is of sufficient strength to cross the threshold level of the detector 38, then the threshold-level detector 38 as powered by a power supply 44 energizes the control-terminal side of a master control relay 46 whose main power terminals interconnect the power supply 44 with the flasher 18, hence activating the flasher 18. The flasher 18 remains active for so long as the threshold-level detector 38 measures sufficient strength of the received signal. In the absence of sufficient strength of the received signal to cross the threshold level, the threshold-level detector cause the master control relay 46 to open the main power circuit between the power source 44 and flasher 18, and hence the flasher 18 falls dormant. The foregoing threshold-level detector circuitry for radio signals is disclosed in connection with an invisible dog fence system including a ground loop antenna and a radio-controlled collar in U.S. Pat. No. 5,207,179—Arthur, the disclosure of which is incorporated fully herein by this reference thereto as if set forth fully here now.

The form of the invention 10 as shown by FIG. 3 which incorporates the relay station 20 has the following aspects to it. As before, the bus B has the mobile transmitter module 22 which transmits radio signal 16. The relay station 20 has a receiver-antenna 48 coupled to receiver 50 which is tuned to signal 16. The signal to which the receiver 50 is tuned to receive is supplied to the same kind of threshold-level detector circuit 38 that is placed in the alert sign control system 24. It also has a sensitivity adjustment 42. If a sufficiently strong signal is measured, that information is supplied to a microprocessor 52. The microprocessor is programmable by entry of instructions through keypad 54. The results of the programming entries are visible to the programmer by display 56. The microprocessor activates an encoder 56 and R.F. transmitter 58 to send a message signal 60 out of transmission-antenna 62 over a different channel than signal 16. The various messages which can be encoded on signal 62 are selectable by the microprocessor 52 from a menu of pre-programmed messages on a memory EPROM 64. Accordingly, the relay station 20 is configured to perpetually monitor the channel which signal 16 is broadcast so that in the event a sufficiently strong signal on channel 16 is received, the relay station responds with transmission of an encoded signal on channel 60.

Here, the alert sign control system 24 is tuned to receive channel 60 and not 16. The threshold-level detector 38 is not applicable to the operation of the control system 24 in the processing of encoded signal 60, and may be omitted (although this is not shown). On the other hand, processing of the encoded signal 60 is handled by a decoder and gate circuit 66. Generally, the encoded signal 60 carries a message corresponding to "GO ACTIVE," which the decoder and gate circuit 66 responds to by energizing the master control relay 46 to close the main power circuit between the power source 44 and flasher 18 to cause the flashing of the flasher 18. The operation of the flasher 18 can be permitted for so long as the decoder and gate circuit 66 receives the "GO ACTIVE" message, in the absence of which the decoder and gate circuit 66 allows the operation of the flasher 18 to fall dormant. Alternatively, the decoder and gate circuit 66 can be configured to cause the flasher 18 to go active upon receipt of the "GO ACTIVE" message, and not cause the flasher to fall dormant until receipt of a corresponding "FALL DORMANT" message. The foregoing circuitry can be routinely produced by persons having ordinary skill in the art, and shares similarities to the circuits disclosed by the above-mentioned patent reference of Arthur, as well as to the U.S. Pat. No. 3,881,169—Malach.

The power sources 44 of the relay station 20 or alert sign 14 can be batteries recharged by means of solar cells (not shown). Alternatively, the power sources 44, and especially the power source 44 of the relay station 20, can be direct connections to the landlines of the public utility electric network.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A method, applicable to a network of bus stops which in some instances have overlapping zones, for controlling a corresponding network of controllable roadway signs that alert drivers that they are approaching a given bus stop with the concurrence of a school bus stopped or proximately stopped there, the method comprising the steps of:

providing a network of bus stops to have enhanced driver-warning safety by virtue of controllable roadway signs;

for each bus stop, providing at least one pertinent controllable roadway sign along a roadway approach to that bus stop, wherein each bus stop has a defined bus stop zone surrounding it, defined as a perimeter centered on that bus stop and encircling even the furthest away pertinent controllable roadway sign therefor;

configuring the network of bus stops and the controllable roadway signs such that there is at least one instance bus-stop zone overlap in which at least one roadway sign pertinent to one bus stop is also situated in the bus stop zone of another bus stop to which such overlapped roadway sign does not pertain;

providing a plurality of school buses for concurrently servicing the network of bus stops, each school bus being configured with a message emitter;

providing an alert system physically associated with each controllable roadway sign, the alert system having operative DORMANT and ACTIVE states wherein the alert system normally rests in the DORMANT state, in the ACTIVE state the alert system provides an obvious sensible warning to drivers reasonably interpretable by them that they are approaching the bus stop to which the ACTIVE alert system/roadway sign pertains contemporaneously as a school bus is indeed stopped or proximately stopped there;

providing detection means and control means for each alert system that cooperatively are responsive to a school bus's emitted messages, and from the perspective of each roadway sign, the pertinent detection means for detecting whether an emitted message originates from such a school bus that is servicing or proximately servicing the pertinent bus stop for that roadway sign and if so, the control means for activating its corresponding alert system to the ACTIVE state in response to at least one given message and returning the alert system to the DORMANT state in response to at least another given message.

2. The method of claim 1 wherein the obvious sensible warning of the alert system comprises one of an audible or visual warning or both.

3. The method of claim 1 further comprising one or more relay stations, each stationed proximate to a selected one of the bus stops of the network of bus stops and pertaining to that selected one of the bus stops;

establishing locations for the one or more relay stations to eliminate any instance of bus-stop zone overlap in which at least one relay station pertinent to one bus stop is also situated in the bus stop zone of another bus stop to which it does not pertain;

each relay station relaying messages between • a school bus stopped or proximately stopped at the pertinent bus stop and • the pertinent roadway signs therefor.

4. The method of claim 3 wherein the detection means of all the roadway signs pertaining to a selected bus stop having a relay station is physically located with the pertinent relay station as the control means are physically located with the roadway signs.

5. The method of claim 4 wherein message emitters comprise a radio transmitter and the detection means and control means comprise one or more radio receivers.

6. The method of claim 5 wherein the detection means are configured to determine whether the radio signal has a requisite given threshold strength or not.

7. The method of claim 6 wherein the detection means configured to determine whether the radio signal is encoded with a requisite given GO ACTIVE message or not.

8. The method of claim 6 wherein the at least one message comprises a radio signal having a requisite given threshold strength and the at least one other message comprises the absence of the radio signal having the requisite given threshold strength.

9. The method of claim 6 wherein the at least one message comprises a radio signal encoded with a given GO ACTIVE message and the at least one other message comprises either the absence of the radio signal encoded with the given GO ACTIVE message or a radio signal encoded with a given FALL DORMANT message.

* * * * *